US011009042B2

(12) United States Patent
Takeuchi et al.

(10) Patent No.: US 11,009,042 B2
(45) Date of Patent: May 18, 2021

(54) FAN SHROUD

(71) Applicant: DENSO CORPORATION, Kariya (JP)

(72) Inventors: Kazuhiro Takeuchi, Kariya (JP); Masashi Matsukawa, Kariya (JP); Isao Kondo, Kariya (JP)

(73) Assignee: DENSO CORPORATION, Kariya (JP)

( * ) Notice: Subject to any disclaimer, the term of this patent is extended or adjusted under 35 U.S.C. 154(b) by 77 days.

(21) Appl. No.: 16/097,853

(22) PCT Filed: May 10, 2017

(86) PCT No.: PCT/JP2017/017733
§ 371 (c)(1),
(2) Date: Oct. 31, 2018

(87) PCT Pub. No.: WO2017/195837
PCT Pub. Date: Nov. 16, 2017

(65) Prior Publication Data

US 2019/0145427 A1 May 16, 2019

(30) Foreign Application Priority Data

May 11, 2016 (JP) ..... JP2016-095197
Feb. 20, 2017 (JP) ..... JP2017-029369

(51) Int. Cl.
*F04D 29/54* (2006.01)
*F04D 29/66* (2006.01)
(Continued)

(52) U.S. Cl.
CPC ..... *F04D 29/547* (2013.01); *F04D 19/002* (2013.01); *F04D 29/164* (2013.01);
(Continued)

(58) Field of Classification Search
CPC ..... F04D 19/002; F04D 29/40; F04D 29/164; F04D 29/326; F04D 29/403;
(Continued)

(56) References Cited

U.S. PATENT DOCUMENTS 2,125,120 A * 7/1938 McMahan ..... F04D 29/547 415/208.2
4,185,688 A * 1/1980 Wiater ..... H01F 27/08 165/122
(Continued)

FOREIGN PATENT DOCUMENTS

CN 103104517 A 5/2013
EP 0367079 A1 * 5/1990 ..... F04D 29/547
(Continued)

*Primary Examiner* — David E Sosnowski
*Assistant Examiner* — Danielle M. Christensen
(74) *Attorney, Agent, or Firm* — Harness, Dickey & Pierce, P.L.C.

(57) ABSTRACT

A fan shroud, in which air flows from a suction port to an outlet port, includes: a bell mouth part having a circular wall, the outlet port being formed by the bell mouth part; and a rectangle part having a proximity wall located adjacent to the circular wall and a distal wall distant from the circular wall than the proximity wall, the suction port being formed by the rectangle part. The proximity wall has a most close area that is most close to the circular wall. The circular wall has an extended wall part extended in an axial direction of a propeller fan than a residual portion of the circular wall. The extended wall part is provided along a rotational direction of the propeller fan from a position opposing the most close area.

8 Claims, 13 Drawing Sheets

(51) Int. Cl.
*F04D 29/16* (2006.01)
*F04D 29/32* (2006.01)
*F04D 29/68* (2006.01)
*F04D 19/00* (2006.01)

(52) U.S. Cl.
CPC ..... *F04D 29/326* (2013.01); *F04D 29/667* (2013.01); *F04D 29/681* (2013.01); *F05D 2240/11* (2013.01)

(58) Field of Classification Search
CPC ..... F04D 29/4226; F04D 29/4253; F04D 29/526; F04D 29/547; F04D 29/66; F04D 29/667; F04D 29/681
See application file for complete search history.

(56) References Cited

U.S. PATENT DOCUMENTS 4,548,548 A * 10/1985 Gray, III ..... F01P 5/06 123/41.49
5,567,200 A * 10/1996 Swartzendruber ... A01K 1/0052 454/338
6,406,258 B1 * 6/2002 Lin ..... F04D 29/547 415/208.5
7,481,615 B2 * 1/2009 Park ..... F04D 29/667 415/173.5
8,221,074 B2 * 7/2012 Nelson ..... F04D 29/646 415/213.1
9,151,294 B2 * 10/2015 Huang ..... F04D 29/547
9,829,010 B2 * 11/2017 Yoshida ..... F04D 29/164
2003/0026699 A1 * 2/2003 Stairs ..... F04D 29/582 416/192
2014/0334917 A1 * 11/2014 Yoshida ..... F01P 5/06 415/119
2016/0341220 A1 11/2016 Kondou et al.

FOREIGN PATENT DOCUMENTS

JP 2011052556 A 3/2011
JP 2013142374 A 7/2013
WO WO-2015125485 A1 8/2015

* cited by examiner

COMPARATIVE EXAMPLE

FAN SHROUD

CROSS REFERENCE TO RELATED APPLICATIONS

This application is a U.S. National Phase Application under 35 U.S.C. 371 of International Application No. PCT/JP2017/017733 filed on May 10, 2017. This application is based on and claims the benefit of priority from Japanese Patent Application No. 2016-095197 filed on May 11, 2016 and Japanese Patent Application No. 2017-029369 filed on Feb. 20, 2017. The entire disclosures of all of the above applications are incorporated herein by reference.

TECHNICAL FIELD

The present disclosure relates to a fan shroud in which air flows from a suction port to an outlet port.

BACKGROUND ART

Patent Literature 1 describes a fan shroud in which air flows from a suction port to an outlet port, in order to reduce rotation noise. According to a first aspect of the fan shroud described in Patent Literature 1, an outer periphery of the fan shroud has a narrow part where the distance to the perimeter of a fan is short, compared with the other part. A projection part projected toward the upstream of intake air than the fan and projected outward than an air introduction part is extended from the narrow part in the rotational direction of the fan. According to a second aspect of the fan shroud, an outer periphery of the fan shroud has a narrow part where the distance to the perimeter of a fan is short, compared with the other part. A covering plate extended to have a predetermined length from a pipe part toward the center of the fan is provided at a position extended from the narrow part in the rotational direction of the fan and located downstream of the fan in a flow of intake air. The first aspect and the second aspect are described to equalize the amount of air drawn by the fan to reduce the rotation noise.

PRIOR ART LITERATURES

Patent Literature

Patent Literature 1: JP 2013-142374 A

SUMMARY OF INVENTION

In the first aspect, since the projection part projected from the outer periphery of the fan shroud increases the size of the fan outward, it becomes difficult to mount the fan shroud to a vehicle. In the second aspect, since the covering plate is formed to interrupt the flow of air, the air amount decreases.

It is an object of the present disclosure to provide a fan shroud in which rotation noise can be reduced without affecting a flow rate of air while the fan shroud is easily mounted to a vehicle.

According to the present disclosure, a fan shroud in which air flows from a suction port to an outlet port includes: a bell mouth part having a circular wall that houses a propeller fan, the outlet port being formed by the bell mouth part; and a rectangle part having a proximity wall located adjacent to the circular wall, and a distal wall distant from the circular wall than the proximity wall, the suction port being formed by the rectangle part. The proximity wall has a most close area that is most close to the circular wall. The circular wall has an extended wall part extended in an axial direction of the propeller fan than a residual portion, and the extended wall part is provided along a rotational direction of the propeller fan from a position opposing the most close area.

According to the present disclosure, an axial flow Fa can be generated and a swirl flow Fb can be restricted by providing the extended wall part, to reduce the rotation noise.

The reference in the parenthesis described in "summary of invention" and "claims" shows a correspondence relation with "embodiments" mentioned later, and "summary of invention" and "claims" are not limited to "embodiments" mentioned later.

DESCRIPTION OF EMBODIMENTS

Figure 1:
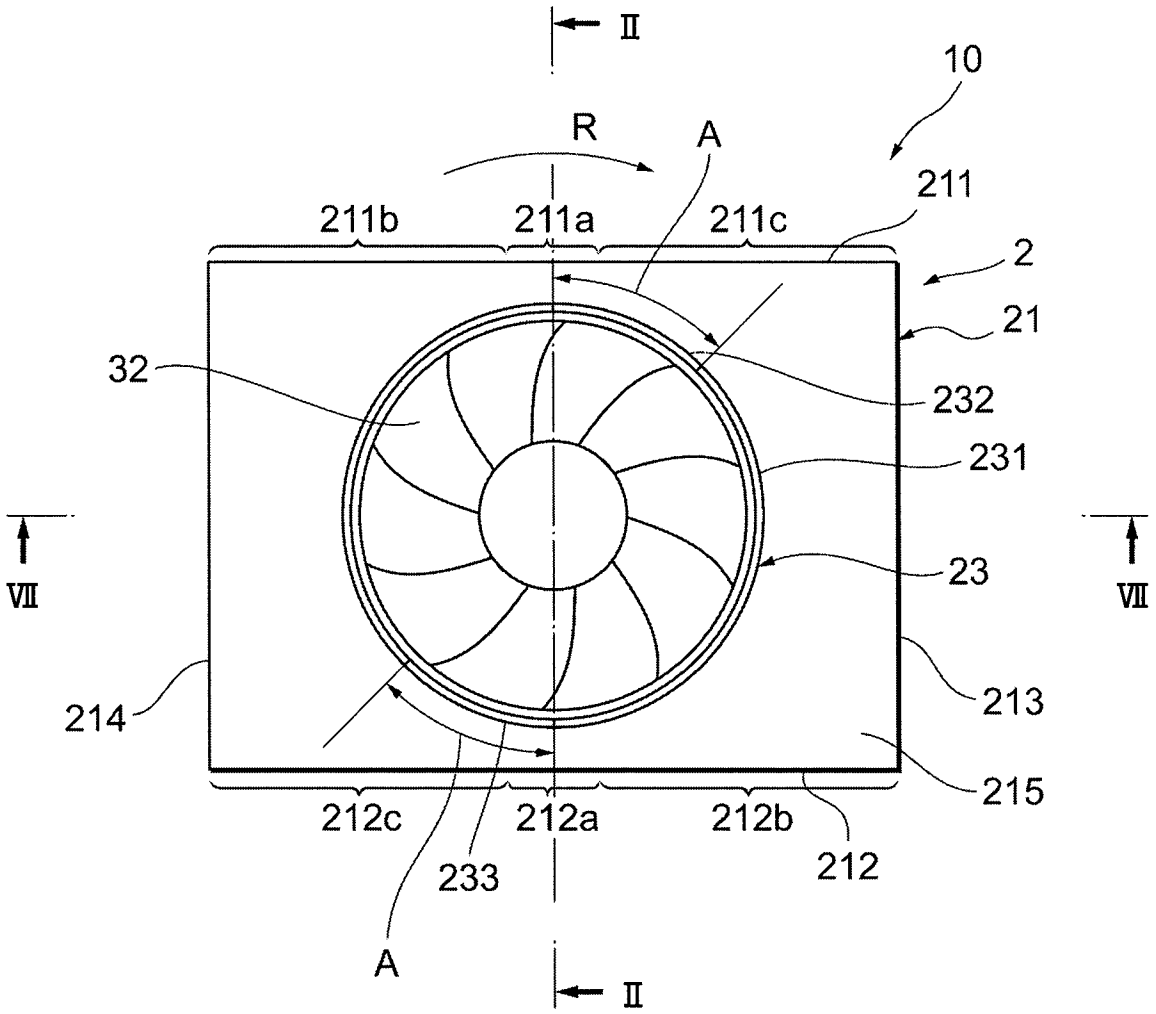
FIG. 1 is a front view illustrating a fan shroud according to a first embodiment.

Hereafter, an embodiment is described, referring to the drawings. For easy understanding, the same mark is attached to the same component among the drawings, and the redundant explanation is omitted.

Figure 2:
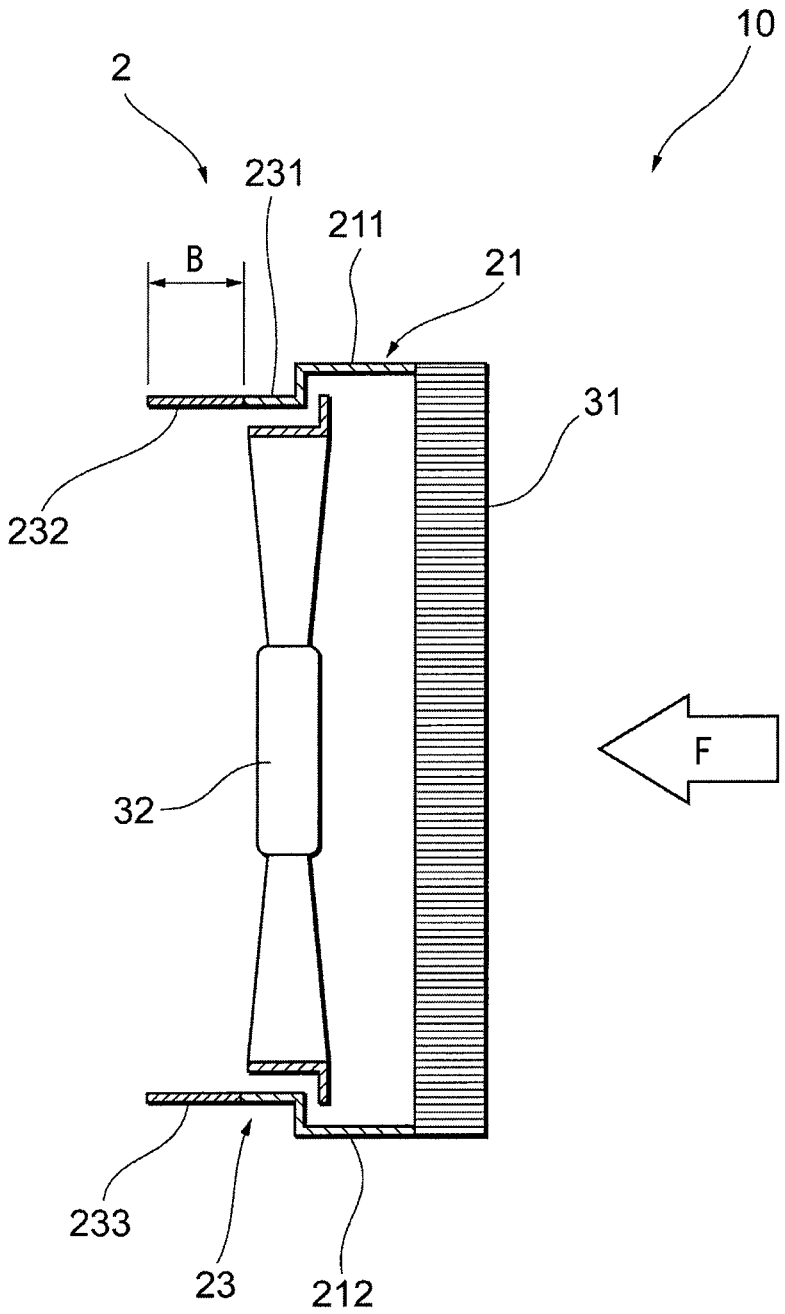
FIG. 2 is a sectional view taken along a line II-II of FIG. 1.

As shown in FIG. 1 and FIG. 2, a fan shroud 2 according to a first embodiment is applied to a cooling system 10 for a vehicle. The cooling system 10 includes the fan shroud 2, a heat exchanger 31, a propeller fan 32, and a drive motor that is not illustrated.

The heat exchanger 31 functions as a condenser used for an air-conditioner, or a radiator used for cooling an engine. The heat exchanger 31 may be one which functions as a condenser or a radiator, or may have two heat exchangers respectively function as a condenser and a radiator.

The condenser is an apparatus of a refrigerating cycle for an air-conditioner. An air channel is prepared in the condenser to exchange heat between outside air and refrigerant gas flowing from a compressor and having high temperature and high pressure. Liquid refrigerant condensed by the heat exchange with air flows to a downstream side apparatus of the refrigerating cycle.

The radiator is an apparatus which cools the cooling water of the engine. The cooling water cools the circumference of a combustion chamber of the engine and becomes to have high temperature. The cooling water is made to flow into the radiator by a pump. An air channel is prepared in the radiator so that heat is exchanged between the hot cooling water and outside air. The cooling water cooled by the heat exchange with air flows back to the engine to cool the engine again.

The fan shroud 2 forms an air flow F to send air to pass through the air channel of the heat exchanger 31. Air flows from a suction port to an outlet port of the fan shroud 2. The fan shroud 2 has a rectangle part 21 and a bell mouth part 23.

The rectangle part 21 has proximity walls 211, 212 and distant walls 213, 214 to form a rectangle frame along the perimeter of the heat exchanger 31. The rectangle part 21 has a connection board 215 that connects the proximity wall 211, 212 to the distant wall 213, 214.

The bell mouth part 23 includes a circular wall 231 having the shape of a cylinder. The circular wall 231 is projected from a periphery of a circular opening defined in the connection board 215. The circular wall 231 has the shape of a cylinder along the perimeter of the propeller fan 32.

The propeller fan 32 is rotated by the drive motor to introduce air to the heat exchanger 31. The propeller fan 32 is stored in the bell mouth part 23. The air flow which passes through the heat exchanger 31 is formed by rotation of the propeller fan 32. The fan shroud 2 has a suction port on a side of the heat exchanger 31, and an outlet port on a side of the bell mouth part 23. In this embodiment, the rotational direction of the propeller fan 32 is represented by a rotational direction R.

The proximity wall 211, 212 is a wall component adjacent to the circular wall 231. The distant wall 213, 214 is a wall component distant from the circular wall 231 than the proximity wall 211, 212 is.

The proximity wall 211 has a most close area 211*a* and a pair of connection areas 211*b* and 211*c*. The most close area 211*a* is an area most close to the circular wall 231. The most close area 211*a* is located between the pair of connection areas 211*b* and 211*c*. The connection area 211*b* is connected with the distant wall 213, and the connection area 211*c* is connected with the distant wall 214. When seen from the rotational direction R of the propeller fan 32, the connection area 211*b* is on the upstream side, and the connection area 211*c* is on the downstream side.

The proximity wall 212 has a most close area 212*a* and a pair of connection areas 212*b* and 212*c*. The most close area 212*a* is an area most close to the circular wall 231. The most close area 212*a* is located between the pair of connection areas 212*b* and 212*c*. The connection area 212*b* is connected with the distant wall 214, and the connection area 212*c* is connected with the distant wall 213. When seen from the rotational direction R of the propeller fan 32, the connection area 212*b* is on the upstream side, and the connection area 212*c* is on the downstream side.

Figure 12:
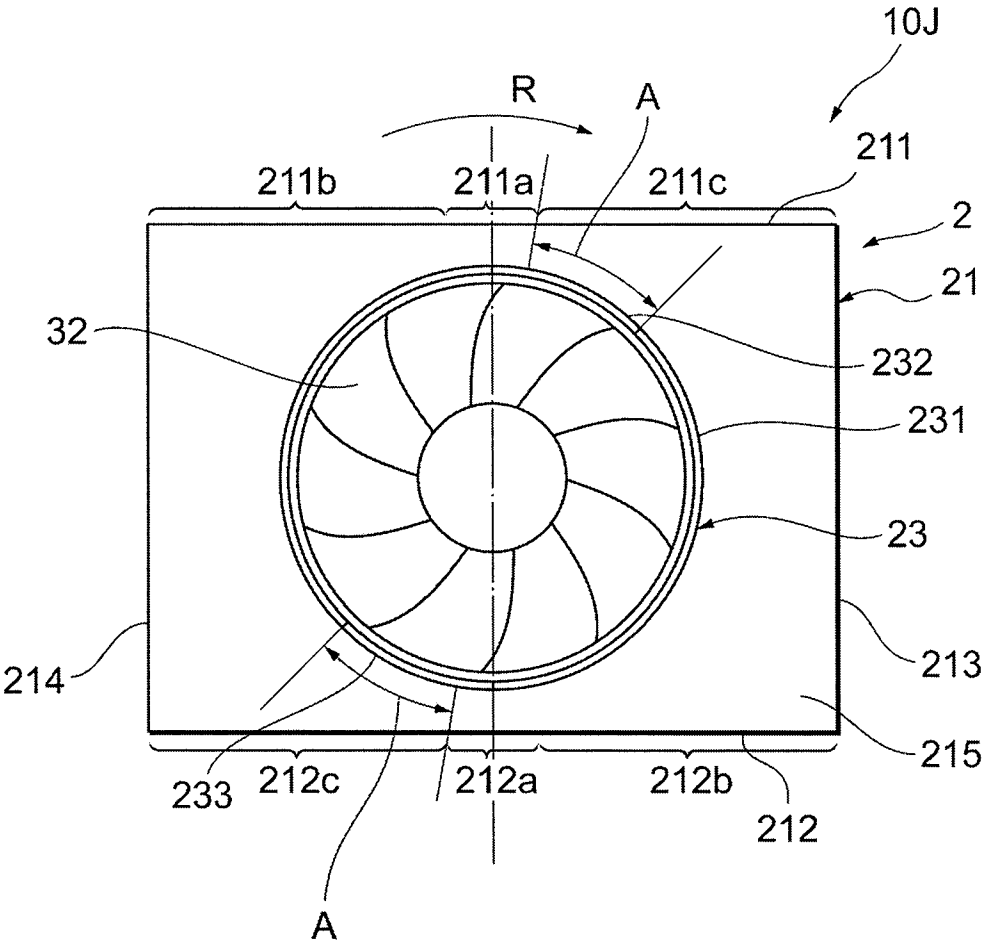
FIG. 12 is a front view illustrating a fan shroud which is a modification of the first embodiment.
Figure 13:
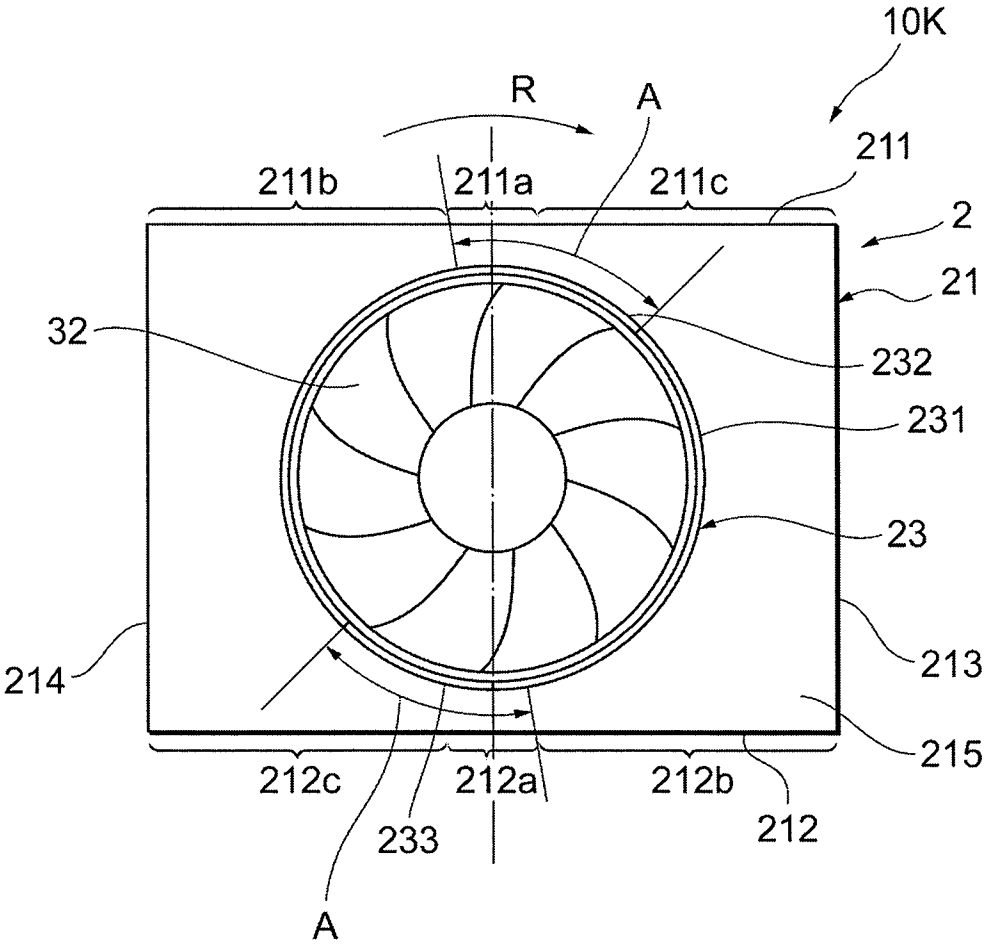
FIG. 13 is a front view illustrating a fan shroud which is a modification of the first embodiment.

The circular wall 231 has an extended wall part 232, 233 extended in the axial direction of the propeller fan 32 than a residual portion of the circular wall 231. The extended wall part 232 is formed along the rotational direction R of the propeller fan 32 from a position opposing the most close area 211*a*. The extended wall part 232 is formed to have a length A from the position opposing the most close area 211*a*. As shown in FIG. 1, the extended wall part 232 is formed to have the length A from the position opposing the central portion of the most close area 211*a* and corresponding to a line passing through the center of the propeller fan 32. However, the start position of the extended wall part 232 is not limited to correspond to the line passing through the center of the propeller fan 32, if the start position of the extended wall part 232 corresponds to the most close area 211*a*. For example, as shown in FIG. 12 illustrating a cooling system 10J, the extended wall part 232 may start from the most close area 211*a* adjacent to the connection area 211*c* or the connection area 212*c*. Moreover, as shown in FIG. 13 illustrating a cooling system 10K, the extended wall part 232 may start from the most close area 211*a* adjacent to the connection area 211*b* or the connection area 212*b*.

The extended wall part 233 is formed along the rotational direction R of the propeller fan 32 from the position opposing the most close area 212*a*. The extended wall part 233 is formed to have the length A from the position opposing the most close area 212*a*. The extended wall part 232, 233 is projected to have a height B from the residual portion of the circular wall 231.

Figure 3:
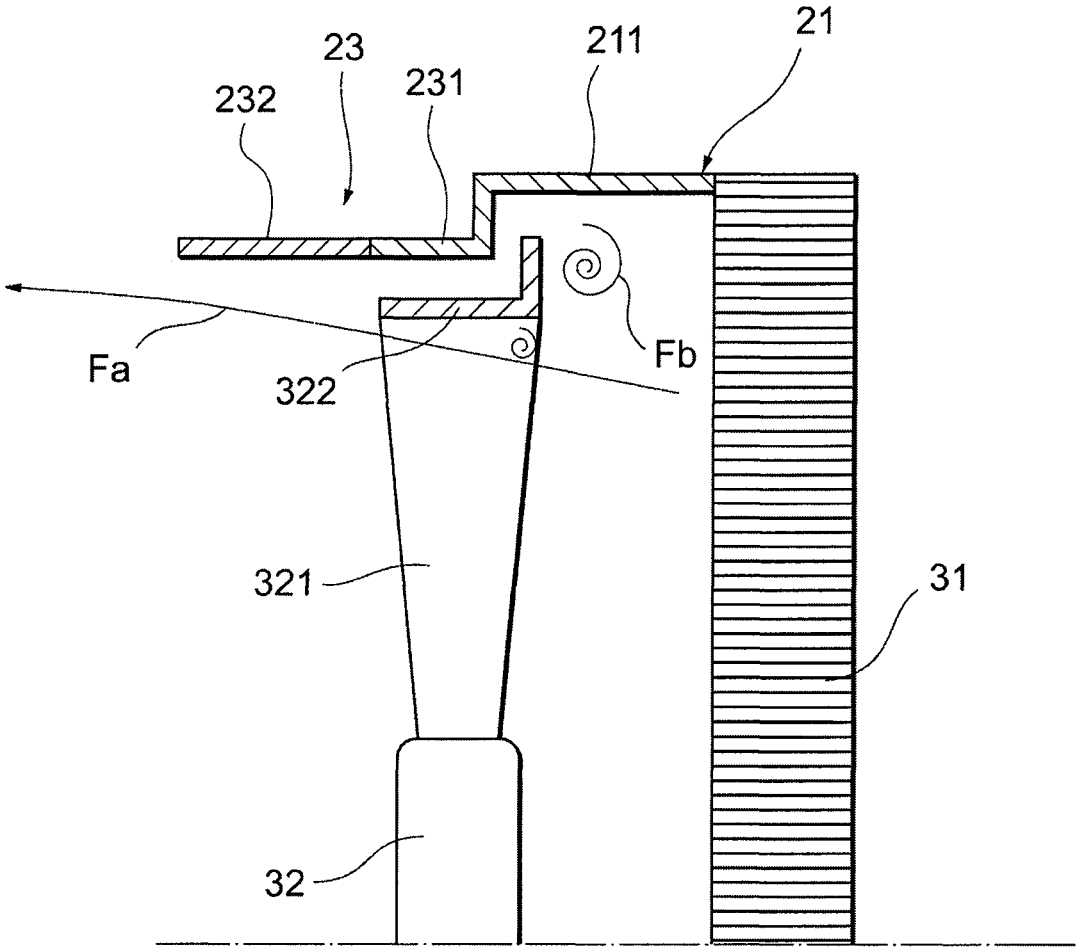
FIG. 3 is an enlarged view of FIG. 2.

As shown in FIG. 3, the propeller fan 32 has a blade part 321 and a blade tip 322 at the tip end of the blade part 321. The extended wall part 232 contributes to generating an axial flow Fa, and restricting a generation of a swirl flow Fb at a location adjacent to the blade tip 322. Therefore, interference between the axial flow Fa and the swirl flow Fb can be restricted to reduce the rotation noise.

Figure 4:
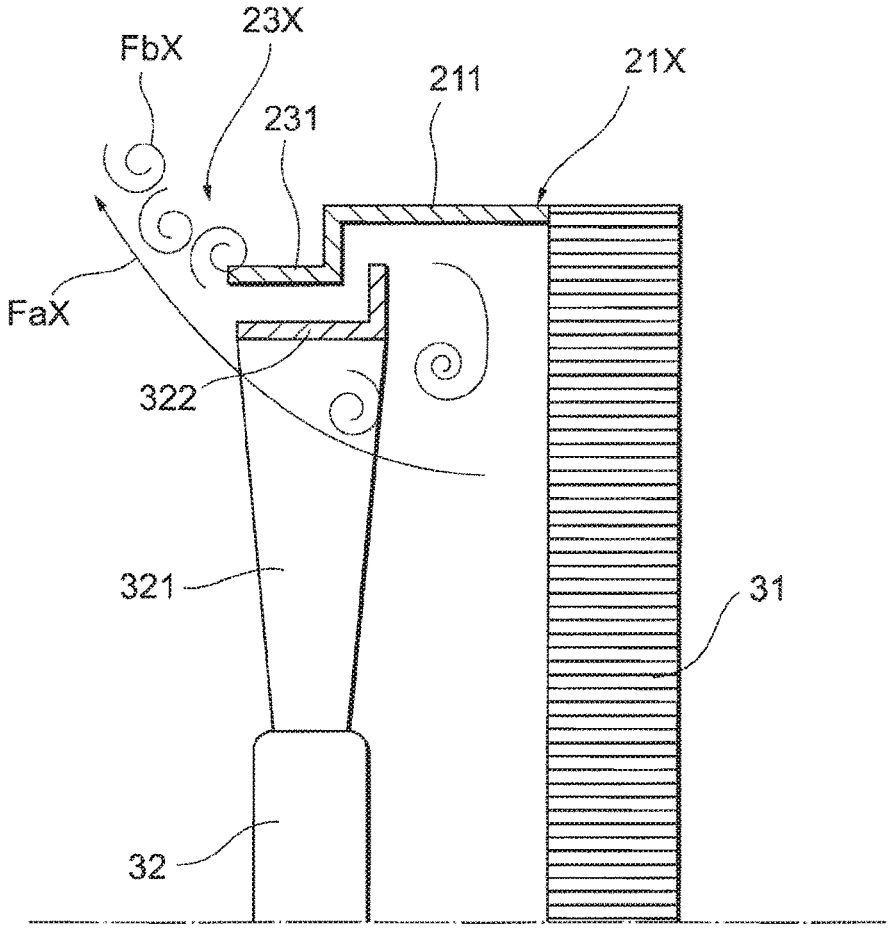
FIG. 4 is a view for explaining a comparative example relative to FIG. 3.

In a comparative example shown in FIG. 4, a fan shroud 21X includes a bell mouth part 23X not having the extended wall part 232, 233. In the comparative example, a slanting flow FaX occurs, instead of the axial flow Fa. Rotation noise increases by the interference between the swirl flow FbX and the slanting flow FaX.

The fan shroud 2 of this embodiment, in which air flows from a suction port to an outlet port, includes the bell mouth part 23 which defines the outlet port, and the rectangle part 21 which defines the suction port. The bell mouth part 23 has the circular wall 231 to house the propeller fan 32. The rectangle part 21 has the proximity wall 211, 212 adjacent to the circular wall 231, and the distant wall 213, 214 distant from the circular wall 231 than the proximity wall 211, 212 is. The proximity wall 211, 212 has the most close area 211*a*, 212*a* most close to the circular wall 231. The extended wall part 232, 233 is extended in the axial direction of the propeller fan 32 from the residual portion of the circular wall 231. The extended wall part 232, 233 is formed along the rotational direction R of the propeller fan 32 from the position opposing the most close area 211*a*, 212*a*.

Thus, as explained by referring to FIG. 3, the axial flow Fa can be generated and the swirl flow Fb can be restricted by forming the extended wall part 232, 233, such that the rotation noise can be reduced. In this embodiment, the center of the rectangle part 21 and the center of the bell mouth part 23 overlap with each other. However, the center of the bell mouth part 23 may be located close to the distant wall 213 or the distant wall 214.

Figure 5:
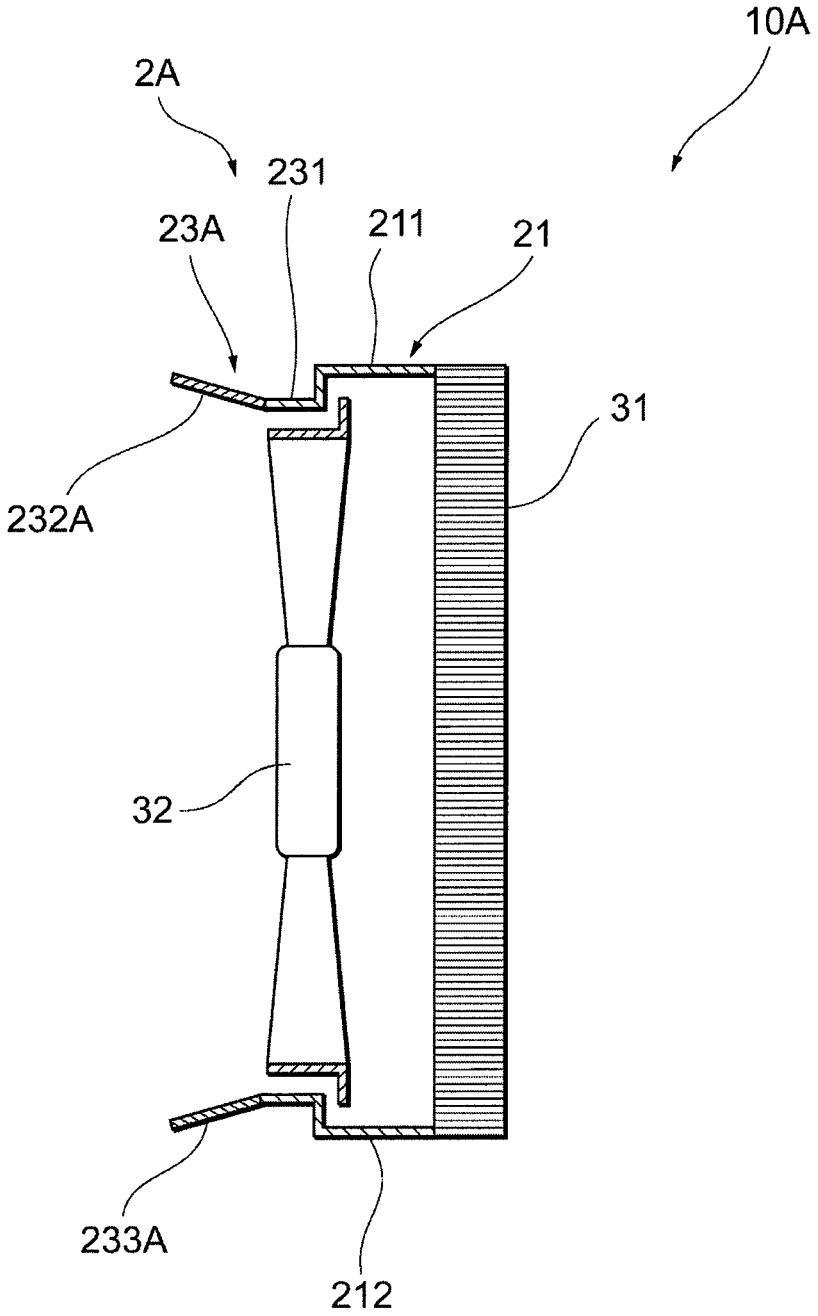
FIG. 5 is a sectional view illustrating a fan shroud according to a second embodiment.

The extended wall part 232, 233 explained by referring to FIGS. 1-3 is a straight wall part extended as it was, without forming an angle relative to the circular wall 231. A fan shroud 2A according to a second embodiment is explained referring to FIG. 5, in which the angle between the circular wall 231 and the extended wall part 232, 233 is changed compared with the first embodiment.

The fan shroud 2A is applied to the cooling system 10A for a vehicle.

The fan shroud 2A includes the rectangle part 21 and the bell mouth part 23A which has the circular wall 231. The circular wall 231 has an extended wall part 232A, 233A extended in the axial direction of the propeller fan 32 from the residual portion. The extended wall part 232A, 233A is inclined outward, as extending from a connection section with the circular wall 231 to the tip end.

Figure 6:
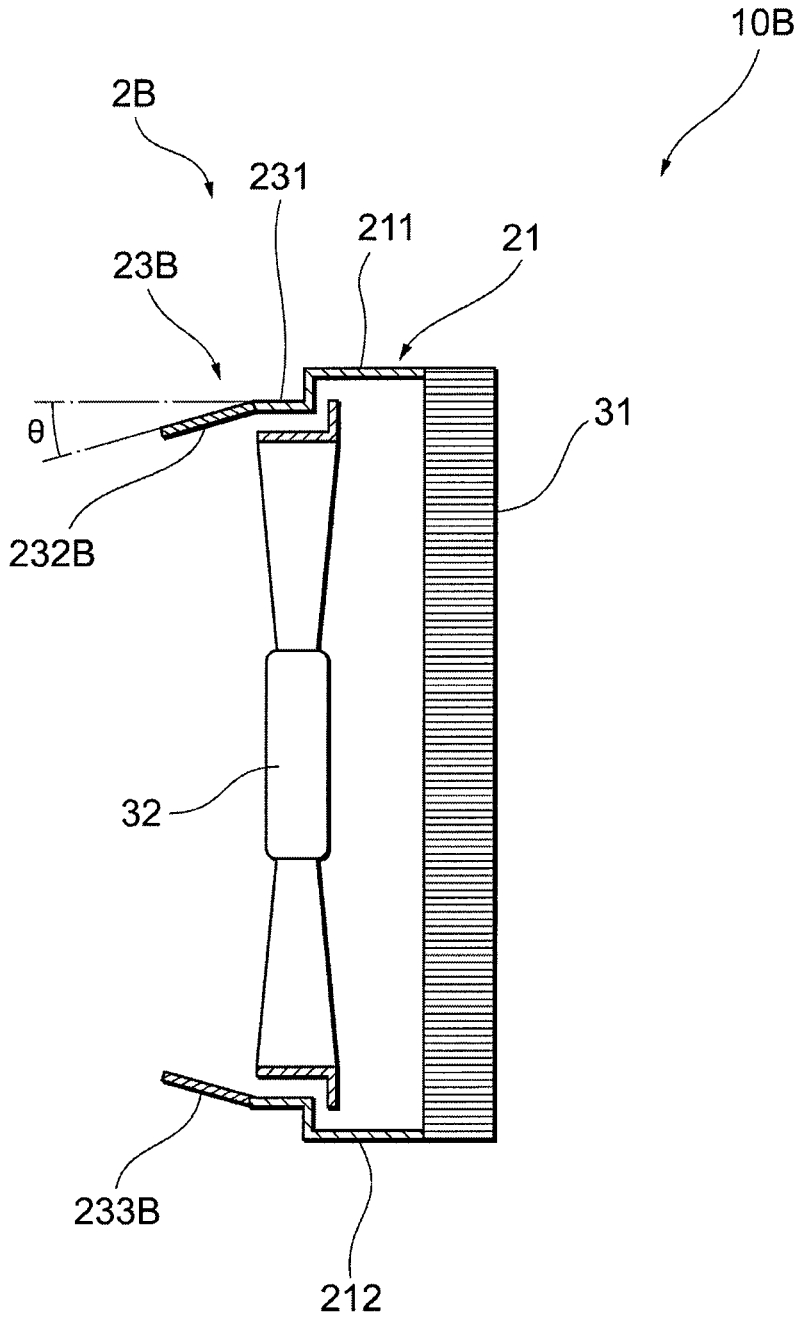
FIG. 6 is a sectional view illustrating a fan shroud according to a third embodiment.

A fan shroud 2B according to a third embodiment is explained, referring to FIG. 6. The fan shroud 2B is applied to the cooling system 10B for a vehicle.

The fan shroud 2B includes the rectangle part 21 and the bell mouth part 23B which has the circular wall 231. The circular wall 231 has an extended wall part 232B, 233B extended in the axial direction of the propeller fan 32 from the residual portion. The extended wall part 232B, 233B is sloped inward, as extending from a connection section with the circular wall 231 to the tip end. The inward tilting angle θ of the extended wall part 232B, 233B is desirably 15 degrees or more.

Thus, in the second embodiment and the third embodiment, the extended wall part 232A, 233A, 232B, 233B is formed to define a predetermined angle to the residual portion of the circular wall 231. Thus, in addition to the effect of the first embodiment, the rotation noise can be further reduced by forming the extended wall part 232A, 233A, 232B, 233B so that a predetermined angle is defined. Moreover, in the third embodiment, the extended wall part 232B, 233B is tilted from the residual portion of the circular wall 231 inward to a side where the propeller fan 32 is stored. Since the extended wall part 232B, 233B is tilted inward, the rotation noise can be further reduced compared with the second embodiment.

Figure 7:
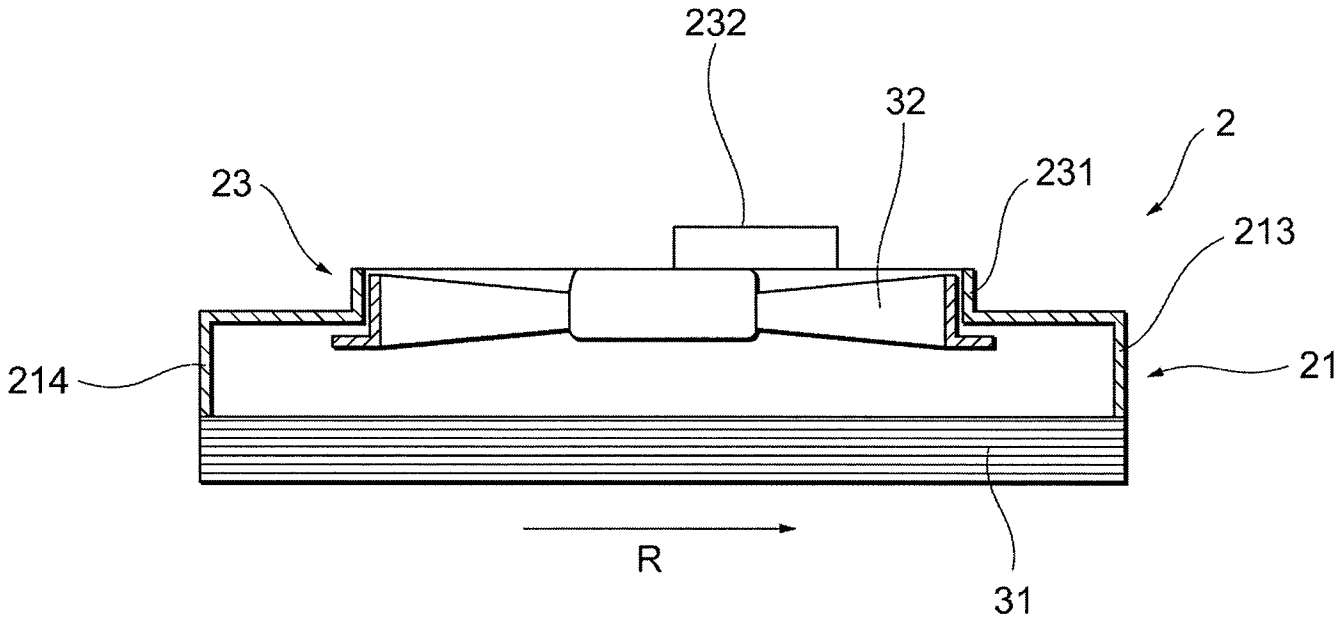
FIG. 7 is a sectional view taken along a line VII-VII of FIG. 1.

The form of the extended wall part 232, 233 is explained, referring to FIG. 7. As shown in FIG. 7, in the fan shroud 2 of the first embodiment, the extended wall part 232 is formed to have the same height from the residual portion as going in the rotational direction R of the propeller fan 32.

Figure 8:
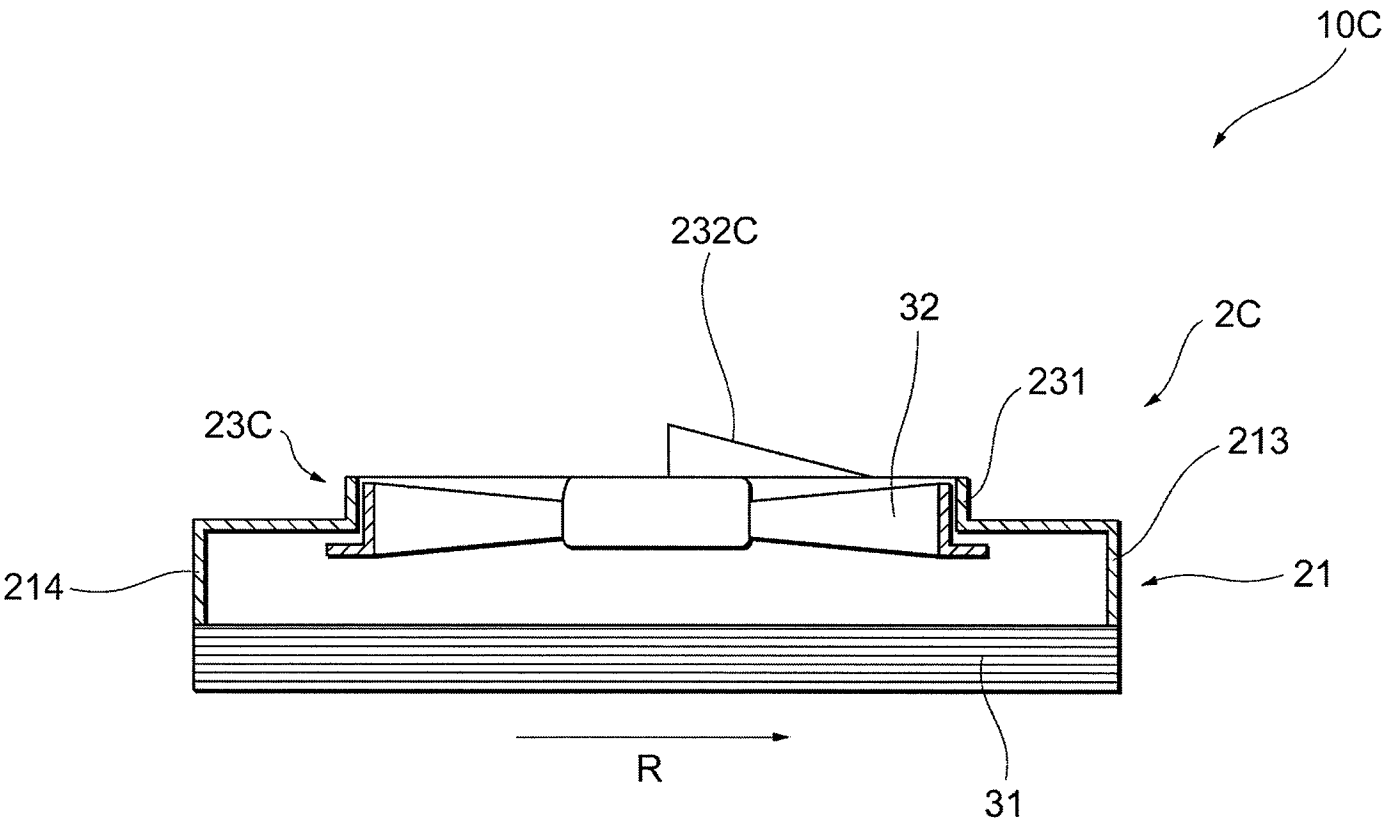
FIG. 8 is a sectional view illustrating a fan shroud according to a fourth embodiment.

A fan shroud 2C according to a fourth embodiment is explained, referring to FIG. 8. The fan shroud 2C is applied to the cooling system 10C for a vehicle. The fan shroud 2C includes the rectangle part 21 and the bell mouth part 23C which has the circular wall 231. The height of the extended wall part 232C is made lower as going in the rotational direction R of the propeller fan 32.

Figure 9:
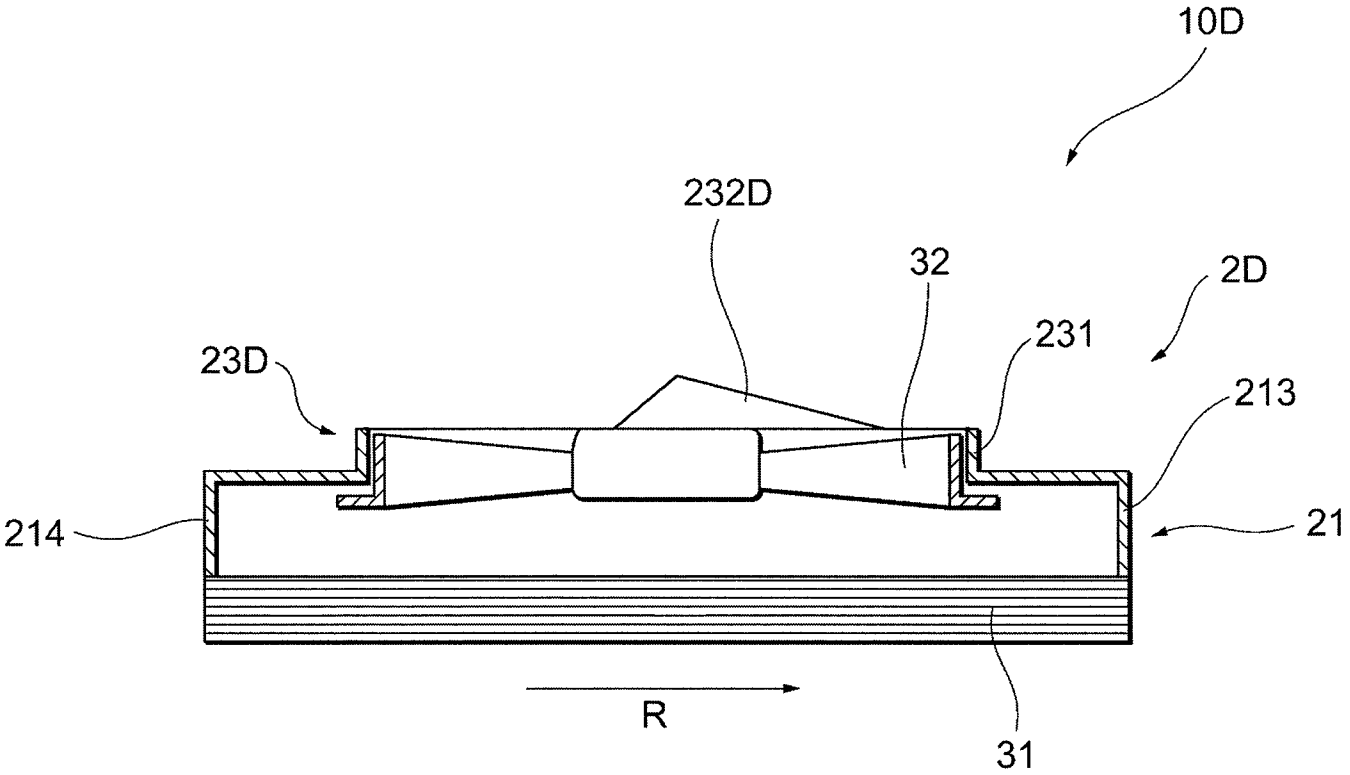
FIG. 9 is a sectional view illustrating a fan shroud according to a fifth embodiment.

A fan shroud 2D according to a fifth embodiment is explained, referring to FIG. 9. The fan shroud 2D is applied to the cooling system 10D for a vehicle. The fan shroud 2D includes the rectangle part 21 and the bell mouth part 23D which has the circular wall 231. The height of the extended wall part 232D is made lower as going in the rotational direction R of the propeller fan 32. The extended wall part 232D is formed to extend also in a direction opposite from the rotational direction R of the propeller fan 32, and the height of the extended wall part 232D is gradually made lower as going from the position opposing the most close area 211*a*.

Thus, in the fourth embodiment and the fifth embodiment, the projection amount of the extended wall part 232C, 232D projected from the residual portion of the circular wall 231 is decreased, as separating from the position opposing the most close area 211*a*. Since the slanting flow explained referring to FIG. 3 and FIG. 4 is easily generated at the position opposing the most close area 211*a*, the effect of restricting the rotation noise can be secured by forming the extended wall part 232C, 232D.

Figure 10:
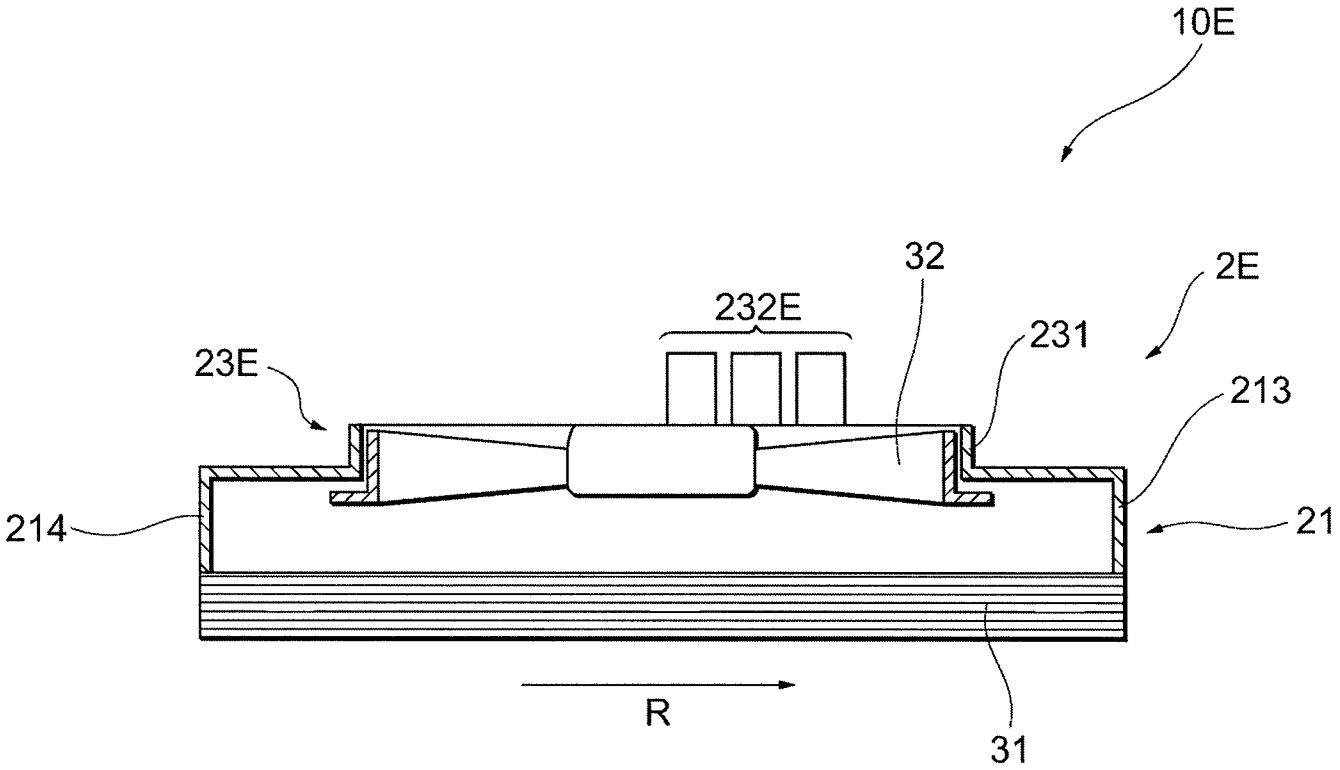
FIG. 10 is a sectional view illustrating a fan shroud according to a sixth embodiment.

A fan shroud 2E according to a sixth embodiment is explained, referring to FIG. 10. The fan shroud 2E is applied to the cooling system 10E for a vehicle. The fan shroud 2E includes the rectangle part 21 and the bell mouth part 23E which has the circular wall 231. The extended wall part 232E is constructed by three split wall parts.

Figure 11:
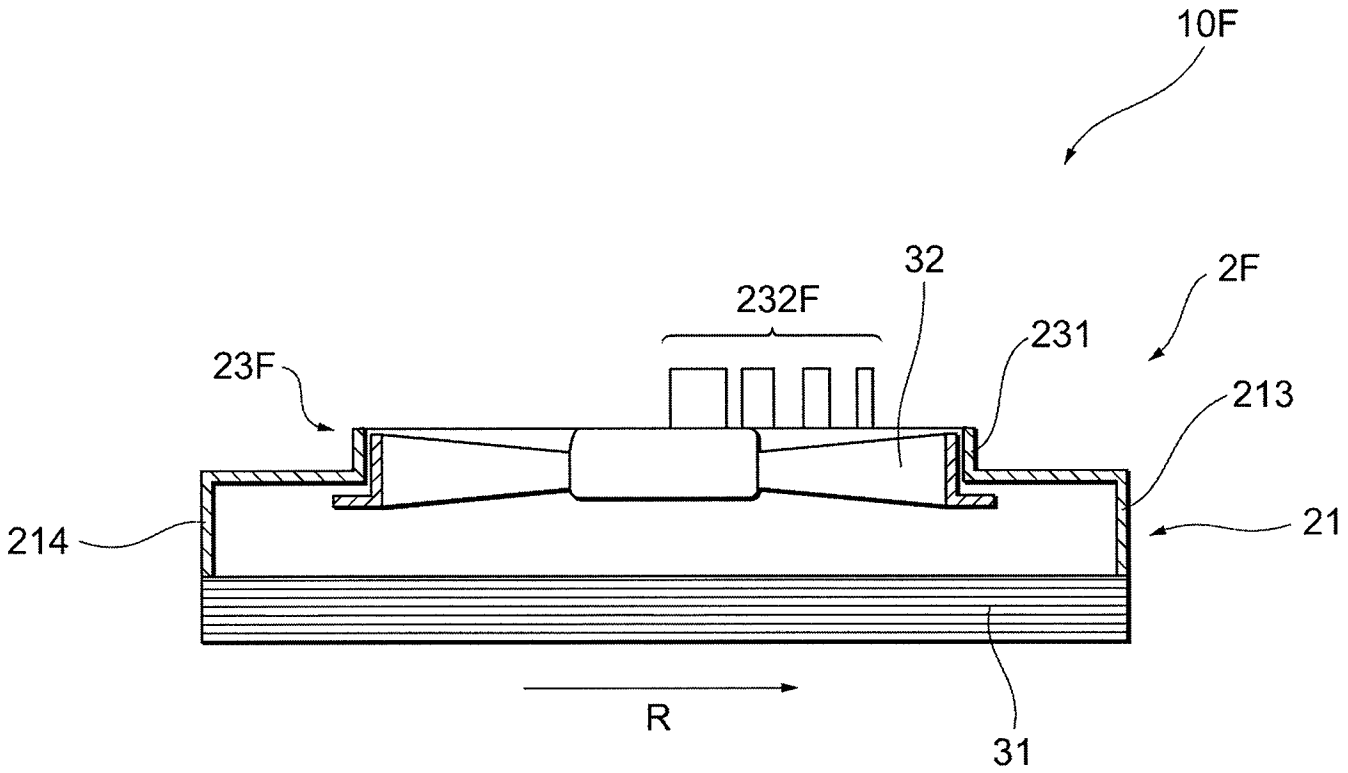
FIG. 11 is a sectional view illustrating a fan shroud according to a seventh embodiment.

A fan shroud 2F according to a seventh embodiment is explained, referring to FIG. 11. The fan shroud 2F is applied to the cooling system 10F for a vehicle. The fan shroud 2F includes the rectangle part 21 and the bell mouth part 23F which has the circular wall 231. The extended wall part 232F is constructed by four split wall parts. Of the four split wall parts of the extended wall part 232F, the split wall part located at the position opposing the most close area 211*a* is the most wide, and the width is made narrower as going in the rotational direction R. The space interval between adjacent two of the four split wall parts of the extended wall part 232F is made larger as going in the rotational direction R. Therefore, the rotation noise can be restricted without changing the height of the extended wall part 232F.

In the above, the embodiment is described referring to specific examples. However, the present disclosure is not limited to the examples. Another embodiment in which a person skilled in the art suitably adds change of design to the examples is also included in the range of the present disclosure as long as the another embodiment equips with the features of the present disclosure. Each element of each example mentioned above can be changed suitably in its arrangement, condition, form, and the like, and is not necessarily limited to what was illustrated. The elements of the examples may be partially combined, unless technical inconsistency arises.

What is claimed is:

1. A fan shroud in which air flows from a suction port to an outlet port, the fan shroud comprising:

a bell mouth part having a circular wall in which a propeller fan is to be housed, the outlet port being formed by the bell mouth part; and a rectangle part having a proximity wall located adjacent to the circular wall and a distal wall more distant from the circular wall than the proximity wall, the suction port being formed by the rectangle part, wherein the proximity wall has a most close area that is most close to the circular wall, an extended wall part extends further from the circular wall, the extended wall part is provided along a rotational direction of the propeller fan from a position opposing the most close area, the extended wall part is arranged to define a predetermined angle relative to the circular wall, the extended wall part is sloped inward from the circular wall along an axial direction of the propeller fan, and the extended wall part has a projection amount that projects from the circular wall, and the projection amount decreases in the rotational direction from the position opposing the most close area.

2. The fan shroud according to claim 1, wherein the extended wall part is constructed by a plurality of split wall parts.

3. A fan shroud in which air flows from a suction port to an outlet port, the fan shroud comprising:

a bell mouth part having a circular wall in which a propeller fan is to be housed, the outlet port being formed by the bell mouth part; and a rectangle part having a proximity wall located adjacent to the circular wall and a distal wall more distant from the circular wall than the proximity wall, the suction port being formed by the rectangle part, wherein the proximity wall has a most close area that is most close to the circular wall, an extended wall part that extends in an axial direction of the propeller fan from the circular wall, the extended wall part is provided along a rotational direction of the propeller fan from a position opposing the most close area, the extended wall part is constructed by a plurality of split wall parts, and a space interval between adjacent split wall parts of the plurality of split wall parts of the extended wall part increases in the rotational direction from the position opposing the most close area.

4. A fan shroud in which air flows from a suction port to an outlet port, the fan shroud comprising:

a bell mouth part having a circular wall in which a propeller fan is to be housed, the outlet port being formed by the bell mouth part; and a rectangle part having a proximity wall located adjacent to the circular wall and a distal wall more distant from the circular wall than the proximity wall, the suction port being formed by the rectangle part, wherein the proximity wall has a most close area that is most close to the circular wall, an extended wall part that extends from the circular wall, the extended wall part is provided along a rotational direction of the propeller fan from a position opposing the most close area, the extended wall part is arranged to define a predetermined angle relative to the circular wall, the extended wall part is sloped outward from the circular wall along an axial direction of the propeller fan;

the extended wall part has a projection amount that projects from the circular wall, and the projection amount decreases in the rotational direction from the position opposing the most close area.

5. A fan shroud in which air flows from a suction port to an outlet port, the fan shroud comprising:

a propeller fan having a blade part and a blade tip at a tip end of the blade part;

a bell mouth part having a circular wall in which the propeller fan is to be housed, the outlet port being formed by the bell mouth part; and a rectangle part having a proximity wall located adjacent to the circular wall and a distal wall more distant from the circular wall than the proximity wall, the suction port being formed by the rectangle part, wherein the proximity wall has a most close area that is most close to the circular wall, an extended wall part that extends in an axial direction of the propeller fan from the circular wall, the extended wall part is provided along a rotational direction of the propeller fan from a position opposing the most close area, a passage is defined between the blade tip of the propeller fan and the circular wall, and the passage is angled between the circular wall and the rectangle part, and the extended wall part has a projection amount that projects from the circular wall, and the projection amount decreases in the rotational direction from the position opposing the most close area.

6. The fan shroud according to claim 5, wherein the circular wall and the extended wall part are connected with each other at a connection position, and the connection position is located adjacent to an end of the propeller fan in the axial direction.

7. The fan shroud according to claim 6, wherein the connection position coincides with the end of the propeller fan in the axial direction.

8. The fan shroud according to claim 5, wherein the passage extends in the axial direction within the circular wall, and the passage extends in a radial direction of the circular wall within the rectangle part.

* * * * *